US007430766B2

(12) United States Patent
Coccia

(10) Patent No.: US 7,430,766 B2
(45) Date of Patent: Oct. 7, 2008

(54) PROTECTIVE ELEMENT PARTICULARLY FOR SHORTS

(75) Inventor: Stefano Coccia, Conegliano (IT)
(73) Assignee: Cytech S.R.L., San Vendemiano (IT)

( * ) Notice: Subject to any disclaimer, the term of this patent is extended or adjusted under 35 U.S.C. 154(b) by 0 days.
(21) Appl. No.: 11/499,798
(22) Filed: Aug. 7, 2006
(65) Prior Publication Data
US 2006/0277662 A1 Dec. 14, 2006

Related U.S. Application Data
(63) Continuation-in-part of application No. 10/193,906, filed on Jul. 15, 2002, now abandoned.

(30) Foreign Application Priority Data
Aug. 28, 2001 (IT) ..... TV2001A0116

(51) Int. Cl.
*A41D 13/00* (2006.01)
(52) U.S. Cl. ..... 2/228; 2/69; 2/467
(58) Field of Classification Search ..... 2/455, 2/467, 267, 400, 238, 228, 227; D2/712–713, D2/731, 738; 450/97–99, 102–105, 153; 602/19; 5/653; 297/2, 19, 11, 195.1, 195.13, 297/200–202, 214; 604/385.01, 385.03, 604/385.04, 386, 387, 400
See application file for complete search history.

(56) References Cited

U.S. PATENT DOCUMENTS

| | | | | |
|---|---|---|---|---|
| 4,805,243 | A * | 2/1989 | Gibbens et al. | 2/228 |
| 4,945,571 | A * | 8/1990 | Calvert | 2/467 |
| 5,271,101 | A * | 12/1993 | Speth et al. | 2/228 |
| RE34,573 | E | 4/1994 | Calvert | |
| 5,388,275 | A * | 2/1995 | Oram | 2/406 |
| 5,397,628 | A | 3/1995 | Crawley et al. | |
| D360,971 | S | 8/1995 | Speth et al. | |
| 5,978,970 | A * | 11/1999 | Bright | 2/267 |
| 6,029,281 | A | 2/2000 | Battley | |
| 6,041,447 | A | 3/2000 | Endler | |
| D453,061 | S | 1/2002 | Garneau | |
| 6,393,618 | B2 | 5/2002 | Garneau | |

FOREIGN PATENT DOCUMENTS

| | | |
|---|---|---|
| EP | 0 260 566 A | 3/1988 |
| FR | 2 727 010 A | 5/1996 |
| GB | 2 187 659 A | 9/1987 |

* cited by examiner

*Primary Examiner*—Gloria Hale
(74) *Attorney, Agent, or Firm*—Modiano & Associati; Albert Josif; Daniel J. O'Byrne

(57) ABSTRACT

A protective element, particularly for shorts, for example for cycling, comprising a support that has, in an upper region, regions that protrude differently and, in a lower region, a layer of material that can be coupled detachably by simple resting on the shorts.

10 Claims, 3 Drawing Sheets

PROTECTIVE ELEMENT PARTICULARLY FOR SHORTS

This is a continuation-in-part of the U.S. application Ser. No. 10/193,906, filed on Jul. 15, 2002 now abandoned.

BACKGROUND OF THE INVENTION

The present invention relates to a protective element particularly for shorts for sports use, such as for example for cycling, motorcycling, and gymnastic activity such as spinning and triathlon.

Currently, in cycling it is known to use shorts, made of optionally partially elasticated material, which cling to the body considerably and are usually worn without underwear.

The main problem for the athlete is that during races or practice the crotch is subjected to continuous stresses, since this part of the body is continuously in contact with the saddle and is therefore subjected to all the jolts produced by the unevenness of the terrain and by the vibrations transmitted by the bicycle frame.

Accordingly, localized reddenings are produced which can degenerate into cuts or blisters that make it difficult, if not impossible, to perform sports practice.

As a partial solution to these drawbacks, it is known to use shorts inside which padding, constituted by a cloth of suitable thickness made of textile material, is sewn internally at the crotch.

However, this solution is not ideal, since although the thickness of the padding can provide relief initially, it has been found that it tends to overheat the crotch and especially that also due to sweating there is continuous sliding between the crotch and the padding, which very soon cancels out the initial benefits.

Moreover, it has been found that the crotch rests on the padding, and the padding rests on the saddle, so as to form compression concentration regions that depend on the stresses applied during sports practice, and this entails even the onset of aches.

As a partial solution to these drawbacks, it is also known to provide shorts with which a bottom is associated by sewing at the crotch region, such bottom having a plurality of chambers arranged laterally to an axis that is longitudinal with respect to the saddle, the chambers being mutually separate and forming diversified contact regions for the crotch.

Although the chambers solve part of the drawbacks mentioned above, this solution and the preceding ones have the drawback that the padding or bottom are made of materials that are substantially rigid or scarcely elastic in a percentage that varies between approximately 0 and 2%, and this renders ineffective any small elastic deformation of the fabric that constitutes the shorts.

This fact limits considerably the freedom of movement of the body; moreover, the larger the padding, the thicker it becomes, further increasing overall rigidity and weight and thus preventing movements even more.

Moreover, a "diaper effect" is produced: when the cyclist dismounts from the bicycle and walks normally, he is thus further hindered in his movements by the presence of the padding or bottom.

Reducing the padding can provide greater freedom of movement, but has a considerable negative effect on the ability to protect from impacts and vibrations on the saddle.

Moreover, the use of padding or bottoms has been found to be subject, during cycling, to the formation of creases, owing to the arc-like shape of the crotch, and these creases produce further regions of discomfort both longitudinally and transversely to the crotch region.

Finally, it is noted that the use of padding in known bottoms affects the entire extension of the product, and this entails a further increase of the mentioned "diaper effect".

In all of the known background art, the padding is in fact present over the entire extension of the product; even in the method that uses differentiated thicknesses, the flat padding part is obtained by compressing the padding, which thus affects also the apparently flat portions of the bottom.

SUMMARY OF THE INVENTION

The aim of the present invention is to eliminate the drawbacks of the cited prior art, by providing a protective element that allows to achieve optimum comfort at the crotch and at the same time great freedom of movement both on the saddle and off the saddle together with an overall light weight of the shorts, thus avoiding the mentioned "diaper effect".

Within this aim, an object of the invention is to provide a protective element that allows to achieve greater comfort for the user while maintaining light weight and/or low thickness characteristics.

Another important object is to provide a protective element that allows optimum adaptation to the anatomical shape of the male or female user once the shorts have been put on.

Another important object is to provide a protective element that can be used in a distinct manner even for users having different clothing sizes.

Another object is to provide a protective element that associates with the preceding characteristics that of having low costs and of being structurally simple, said invention being reliable and safe in use.

This aim and these and other objects that will become better apparent hereinafter are achieved by a protective element, particularly for shorts, characterized in that it is constituted by a support that has, in an upper region, regions that protrude differently and, in a lower region, a layer of material that can be coupled detachably by simple resting on said shorts.

Advantageously, the support has grip means for the user which are suitable to simplify removal and/or positioning of said support on the shorts.

BRIEF DESCRIPTION OF THE DRAWINGS

Further characteristics and advantages of the invention will become better apparent from the following detailed description of a particular embodiment thereof, illustrated only by way of non-limitative example in the accompanying drawings, wherein.

DESCRIPTION OF THE PREFERRED EMBODIMENTS

Figure 1:
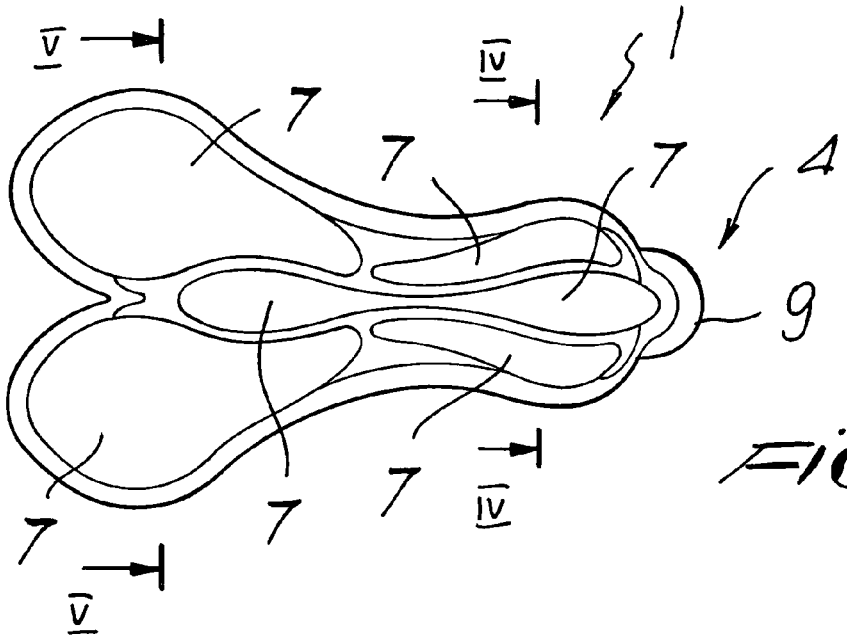
FIG. 1 is a plan view of the protective element.
Figure 2:
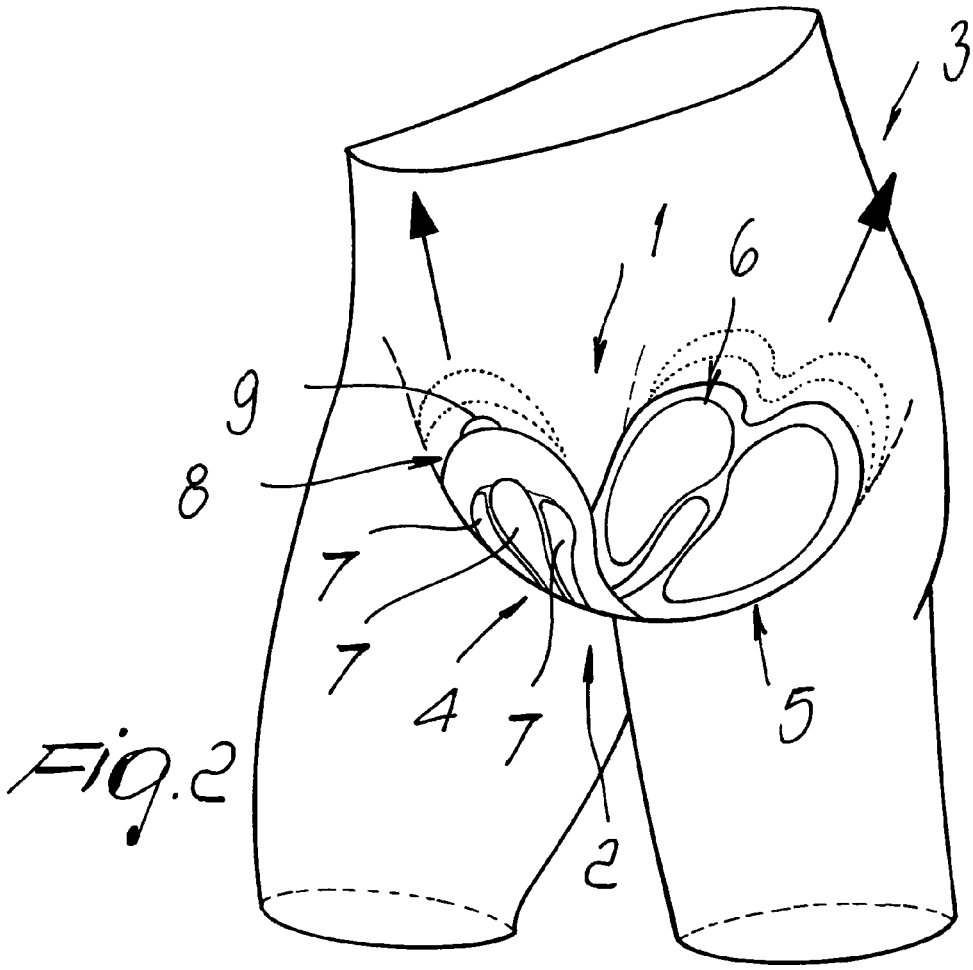
FIG. 2 is a schematic perspective view of a pair of shorts, illustrating the protective element associated therewith.
Figure 3:
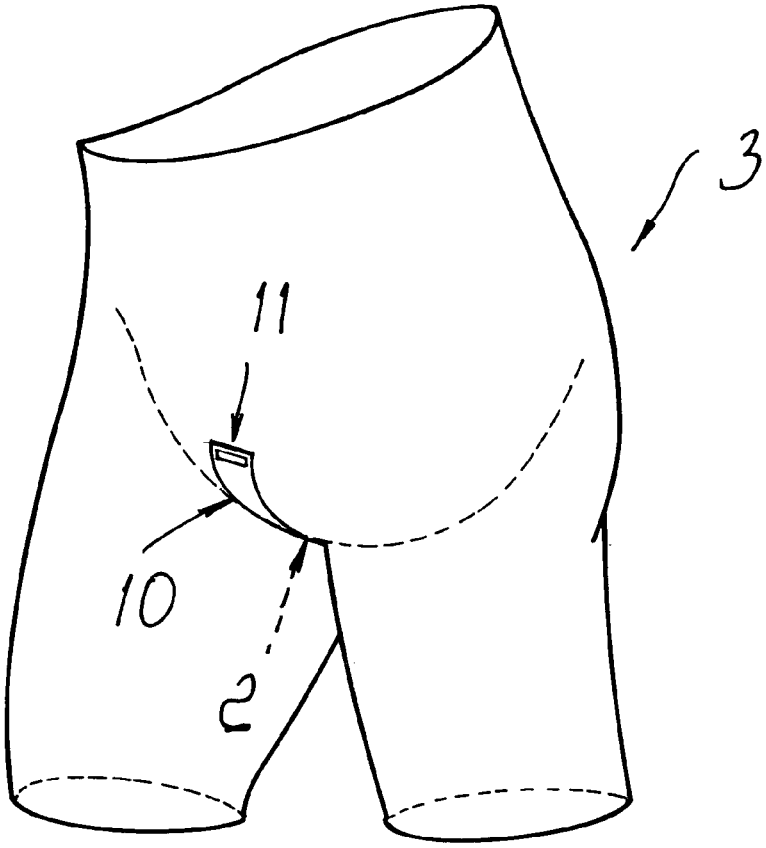
FIG. 3 is a front view of the shorts, illustrating the presence of a tape.
Figure 4:
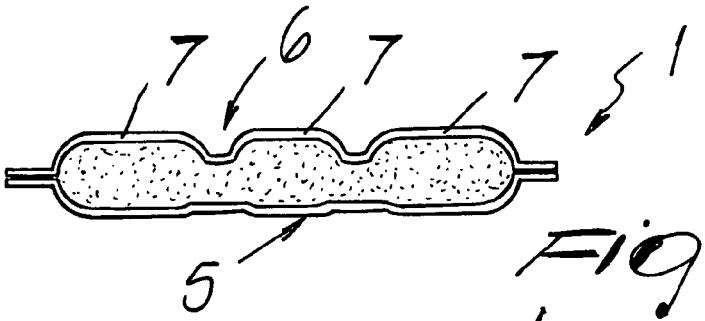
FIG. 4 is a sectional view, taken along the line IV-IV of FIG. 1.
Figure 5:
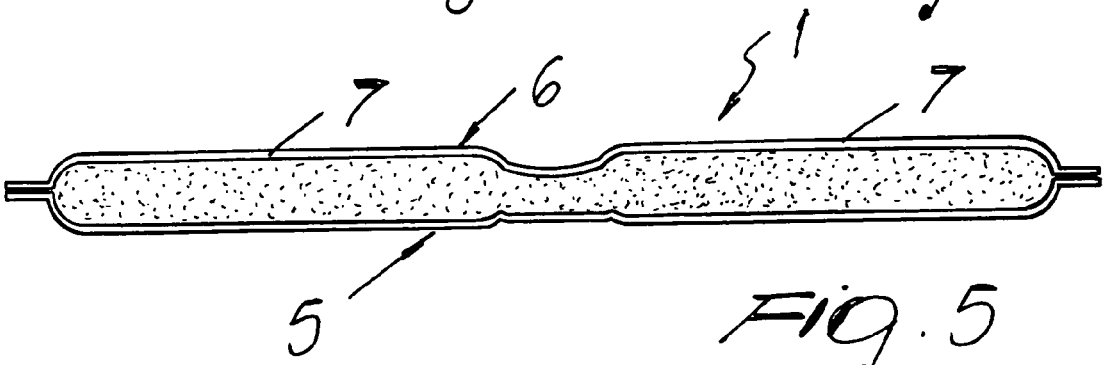
FIG. 5 is a sectional view, taken along the line V-V of FIG. 1.

With reference to the figures, the reference numeral 1 designates a protective element, which is used particularly at the crotch region 2 of shorts 3, for example cycling shorts.

The protective element is constituted by a support 4, which has a lower surface 5 made of a material having a non-smooth, highly porous neoprene base; this material interacts, by contact, with the shorts, which advantageously but not necessarily have very fine grooves that allow to facilitate strong grip between the two parts.

It is therefore sufficient for the user to place the support against the shorts, simply adapting its position according to his or her anatomical shape.

The lower surface 5 of the support 4 may also be made of different materials than neoprene.

Thus, the neoprene base can be replaced by a any gripping layer.

The support 4 further has an upper surface 6 on which differentiated relief regions 7 are provided by thermoforming so as to further increase user comfort.

There are also grip means 8 for the user which are suitable to simplify the removal or positioning of the support with respect to said shorts; such means are constituted by a tab 9, which protrudes frontally with respect to the support 4 in its front region.

Other grip means are constituted by a tape 10, which protrudes inside the shorts in the crotch region 2.

The tape has an opening 11 that allows passage and engagement of a portion of the support to the shorts, so as to allow positioning of the support.

Figure 6:
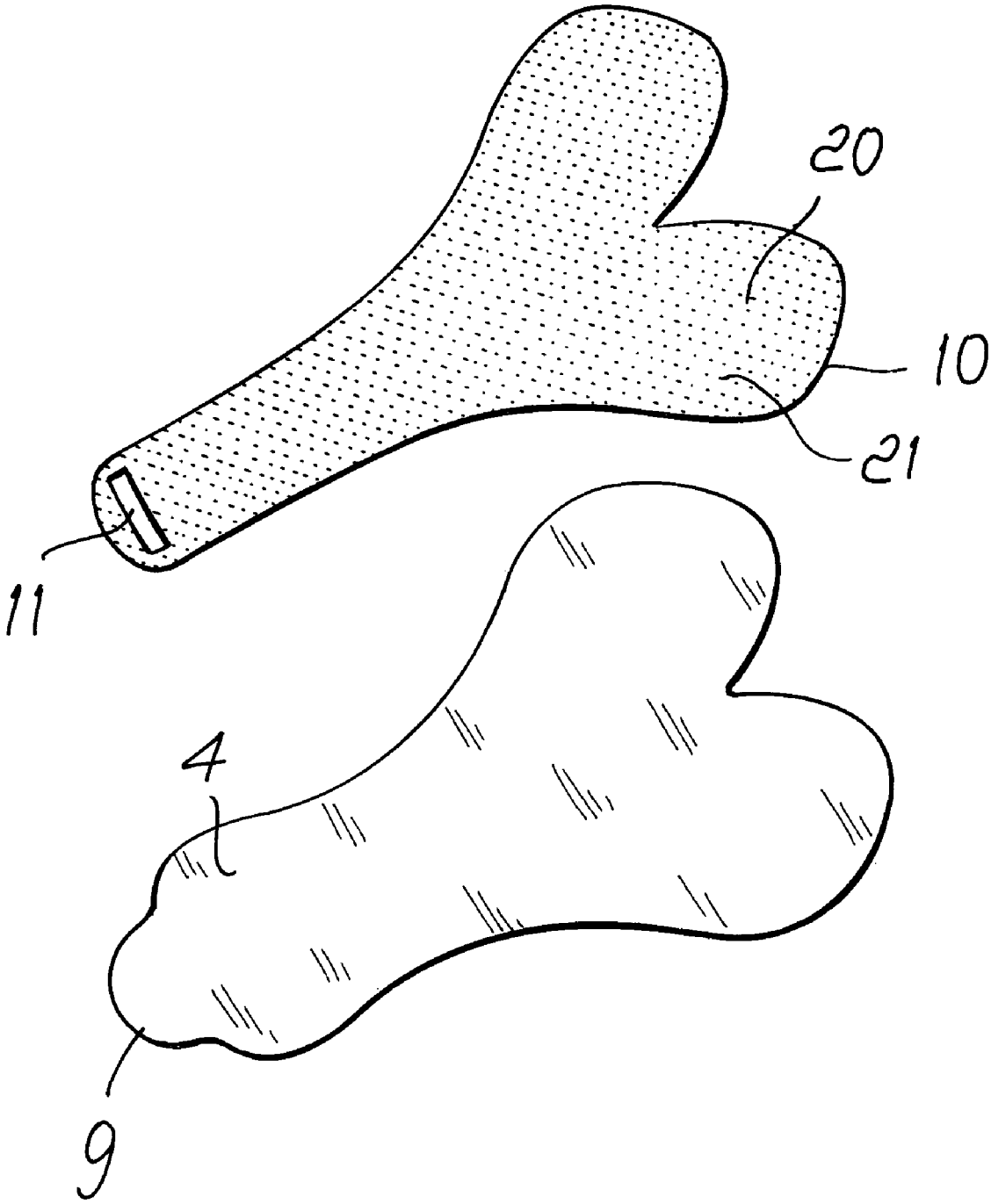
FIG. 6 is a perspective exploded view of the protective element and a tape adapted to be connected thereto.

The tape is advantageously rectangular and also elastic and acts as a sort of coupling guide, which thus allows to insert the support inside it, ensuring greater stability thereof and simultaneously ensuring that it remains at the center of the fork while leaving it free to be positioned at will by the user. As illustrated in FIG. 6, the tape 10 can be a tape having adhesive 20 on both faces thereof so that it can be connected to the protective element 4 and to the shorts.

The tape 10 can be made of plastics, thermoplastic material, can be woven or non-woven and can also be elastic.

The size of the tape can be variable so as to adapt to the user's needs and to the size of the support.

Advantageously, the tape can be provided with a plurality of holes 21 to allow transpiration.

Still further, the tape can be applied by applying pressure, or it can be sewn or it can be connected by applying heat or high-frequency technology or any other conceivable method.

It has thus been observed that the invention has achieved the intended aim and objects, a protective element having been obtained that can be applied to shorts rapidly and easily for the user, the protective element adapting in an optimum manner to the crotch during sports practice or being easily removable during walking or during sports practice.

Moreover, the protective element can be positioned perfectly, with respect to the shorts, by the male or female user by virtue of the temporary mechanical connection provided by simple mutual resting contact.

Moreover, the use of optional shorts without lateral seams increases user comfort, also by way of the presence of the differentiated relief regions: the use of yams with a higher elasticity modulus allows optimum adaptation to the body, in a manner that is far more effective than conventional products, regardless of adaptability to a clothing size.

The supports of the protective element are produced by thermoforming and/or high frequency technology, which allow to form the differentiated relief regions in order to better protect the more delicate parts of the body in contact with the saddle.

These supports adhere naturally to the shorts without requiring uncomfortable stitched seams, by way of fabrics that are mechanically compatible with the shorts, and it is sufficient to position them as required and, if necessary, move them freely forward or backward, to the right or to the left, without limitations.

These supports can therefore be washed separately and be removed at any time and can therefore be used with any type of shorts.

Advantageously, the supports are made of a temperature-regulating microfiber covering, which ensures antibacterial protection and facilitates rapid evaporation of perspiration.

Moreover, removability allows to solve any drawbacks due to possible overheating of the crotch.

Further, removability allows the user to change, during sports practice, the type of protective element according to the sport being practiced, such as for example on-road or off-road use.

Moreover, the particular shape of the protective element, whose surface practically affects only the region of contact with the crotch, has dimensions and a volume that minimize user discomfort, for example during walking.

The materials used may of course be the most pertinent according to specific requirements.

The disclosures in Italian Patent Application No. TV2001A000116 from which this application claims priority are incorporated herein by reference.

What is claimed is:

1. A protective element, in combination with a pair of shorts, comprising a support that has, in an upper surface, differentiated relief regions as far as thickness thereof is concerned and, in a lower surface, a layer of material that can be coupled so as to be detachable by simple resting on said shorts, wherein said layer of material has a base made of highly porous non-smooth neoprene, said material interacting directly by simple contact, with an internal surface of said shorts and comprising at least one tape adapted to be coupled to said shorts and that protrudes inside said shorts in a crotch region, said tape having at least one opening that allows the passage of a portion of said support.

2. The protective element according to claim 1, wherein said support has user grip means that are suitable to simplify removal and/or positioning of said protective element on said shorts.

3. The protective element according to claim 1, wherein said protective element is arranged so as to be detachable at a chosen region of shorts, such as the crotch.

4. The protective element according to claim 1, wherein said protective element is removable from said shorts to be washed separately from said shorts.

5. The protective element according to claim 1, wherein said lower surface facilitates high temporary grip by simple contact with said internal surface of said shorts.

6. The protective element according to claim 1, wherein the arrangement of said element can be preset and modified by the user simply by resting said support on said shorts.

7. The protective element according to claim 1, wherein said differentiated relief regions are provided by thermoforming.

8. The protective element according to claim 2, wherein said user grip means suitable to simplify removal or positioning of the support with respect to said shorts are constituted by at least one tab that protrudes frontally with respect to said support in a front region thereof.

9. The protective element according to claim 1, wherein said tape acts as a coupling guiding element that allows said support to be inserted inside an opening defined in said tape, ensuring greater stability thereof and at the same time ensuring that said support remains positioned where desired by the user.

10. A protective element, in combination with a pair of shorts, comprising a support that has, in an upper surface, differentiated relief regions that protrude differently and, in a lower surface, a layer of material that can be coupled so as to be detachable by simple resting on said shorts, wherein said layer of material has a gripping base made, said material interacting directly, by simple contact with an internal surface of said shorts and comprising at least one tape integral with said shorts and that protrudes inside said shorts in a crotch region, said tape having at least one opening that allows the passage of said support to said shorts.

* * * * *